US007508143B2

(12) United States Patent
Suzuki

(10) Patent No.: US 7,508,143 B2
(45) Date of Patent: Mar. 24, 2009

(54) DRIVING APPARATUS AND METHOD FOR DRIVING LIGHT EMITTING ELEMENTS, AND PROJECTOR

(75) Inventor: Hideo Suzuki, Ome (JP)

(73) Assignee: Casio Computer Co., Ltd., Tokyo (JP)

( * ) Notice: Subject to any disclaimer, the term of this patent is extended or adjusted under 35 U.S.C. 154(b) by 163 days.

(21) Appl. No.: 11/729,261

(22) Filed: Mar. 28, 2007

(65) Prior Publication Data

US 2007/0228504 A1 Oct. 4, 2007

(30) Foreign Application Priority Data

Mar. 31, 2006 (JP) ..... 2006-096504

(51) Int. Cl.
*H05B 37/02* (2006.01)

(52) U.S. Cl. ..... 315/291; 315/308; 315/312

(58) Field of Classification Search ..... 315/209 R, 315/224–226, 246, 291, 307–308, 312, 360; 345/82, 84, 99, 204; 353/29, 79
See application file for complete search history.

(56) References Cited

U.S. PATENT DOCUMENTS

| | | | | |
|---|---|---|---|---|
| 2003/0015972 | A1* | 1/2003 | Suzuki | 315/291 |
| 2004/0246241 | A1* | 12/2004 | Sato et al. | 345/204 |
| 2006/0186830 | A1* | 8/2006 | Shami et al. | 315/291 |
| 2007/0114951 | A1* | 5/2007 | Tsen et al. | 315/291 |

FOREIGN PATENT DOCUMENTS

JP 2004-311635 A 11/2004

OTHER PUBLICATIONS

Related U.S. Appl. No. 11/729,163, filed Mar. 28, 2007; Inventor: Hideo Suzuki; Title: "Driving Apparatus and Method for Driving Light Emitting Elements, and Projector".

* cited by examiner

*Primary Examiner*—David Hung Vu
*Assistant Examiner*—Tung X Le
(74) *Attorney, Agent, or Firm*—Frishauf, Holtz, Goodman & Chick, P.C.

(57) ABSTRACT

A light-emitting element driving apparatus, method and projector are provided, in which a common power supplying section drives plural light emitting elements of different rated current in a time sharing driving manner whereby the light emitting elements emit light stably.

The light-emitting element driving apparatus comprises a direct-current power source 12 for supplying direct current I-in, a light-emitting element selection controlling section 11 for selecting light emitting elements 10R, 10G, 10B of different rated current, successively, a power supplying section 13 for changing the direct current supplied from the direct-current power source 12 to predetermined output current and supplying the output current I-out to the light emitting element selected by the light-emitting element selection controlling section 11, and a connection controlling section 15 for connecting one subsidiary capacitor among subsidiary capacitors 14R, 14G, 14B in parallel with one appropriate light emitting element out of the light emitting elements 10R, 10G, 10B at a predetermined timing.

17 Claims, 4 Drawing Sheets

DRIVING APPARATUS AND METHOD FOR DRIVING LIGHT EMITTING ELEMENTS, AND PROJECTOR

BACKGROUND OF THE INVENTION

The present invention relates to a light-emitting element driving apparatus and method for driving plural light-emitting elements in a time sharing driving manner, and a projector using such apparatus and/or method.

In conventional projectors, for example, a field sequential color system and color image synthesis system are used to project color images.

In the field sequential color system, a red image (R image), green image (G image), and blue image (B image) are projected onto a screen sequentially and periodically at a so high switching speed that human eye can visually recognize one color image. A projector of a field sequential color system is in practical use, in which DMD (Digital Micro-mirror Device) is used as an optical modulating device for transmitting by means of optical-beam image information output from a personal computer. In the projector, light from a light source is collected onto DMD through a color wheel (color filter) having red, green and blue areas arranged in its rotational direction, and light reflected on the color wheel is projected onto a screen. While the color wheel rotates, DMD is mechanically driven in synchronization with the rotating color wheel so as to correspond to a red image, green image and blue image, and further a red, green, and blue color image component reflected on DMD are projected onto the screen, whereby a color image is composed on the screen.

In recent, a projector of another type has been developed, which uses a red light emitting element (LED), green light emitting element (LED), and blue light emitting element (LED) serving as a light source, and these LEDs are driven successively in a time division driving manner, whereby respective color images are projected onto the screen without using the color wheel (Refer to Patent Document: Japanese Patent No. 2004-311635 A).

SUMMARY OF THE INVENTION

According to one aspect of the invention, there is provided a light-emitting element driving apparatus for driving plural light emitting elements of different rated current, which comprises capacitors provided each to be connected in parallel with an appropriate light emitting element among the plural light emitting elements, a direct-current power source for supplying direct current, a light-emitting element selection controlling section for selecting a light emitting element out of the plural light emitting elements successively, a power supplying section for changing the direct current supplied from the direct-current power source to predetermined output current and supplying the output current to the light emitting element selected by the light-emitting element selection controlling section, and a connection controlling section for connecting at a predetermined timing the capacitor in parallel with the light emitting element selected by the light-emitting element selection controlling section.

According to another aspect of the invention, there is provided a method of driving plural light emitting elements of different rated current in a light-emitting element driving apparatus, which has a direct-current power source for supplying direct current and capacitors provided each to be connected with an appropriate light emitting element among the plural light emitting elements, which method comprises the steps of (a) selecting a light emitting element out of the plural light emitting elements successively, (b) changing the direct current supplied from the direct-current power source to predetermined output current and supplying the output current to the selected light emitting element, and (c) connecting the capacitor in parallel with the selected light emitting element at a predetermined timing.

According to still another aspect of the invention, there is provided a projector provided with a light-emitting element driving apparatus for driving plural light emitting elements of different rated current, which comprises capacitors provided each to be connected in parallel with an appropriate light emitting element among the plural light emitting elements, a direct-current power source for supplying direct current, a light-emitting element selection controlling section for selecting a light emitting element out of the plural light emitting elements successively, a power supplying section for changing the direct current supplied from the direct-current power source to predetermined output current and supplying the output current to the light emitting element selected by the light-emitting element selection controlling section, and a connection controlling section for connecting at a predetermined timing the capacitor in parallel with the light emitting element selected by the light-emitting element selection controlling section.

DETAILED DESCRIPTION OF THE PREFERRED EMBODIMENTS

Now, an embodiment of a light-emitting element driving apparatus for driving plural LEDs (light emitting diodes) according to the present invention will be described with reference to the accompanying drawings. The light-emitting element driving apparatus (hereinafter, "driving apparatus") is provided with three LEDs 10R, 10G and 10B, which are driven in a time sharing manner to emit red light (R light), green light (G light) and blue light (B light), respectively. Note that the number of LEDs is not limited to three units and light to be emitted is not limited to red, blue and green light in the present invention.

Figure 1:
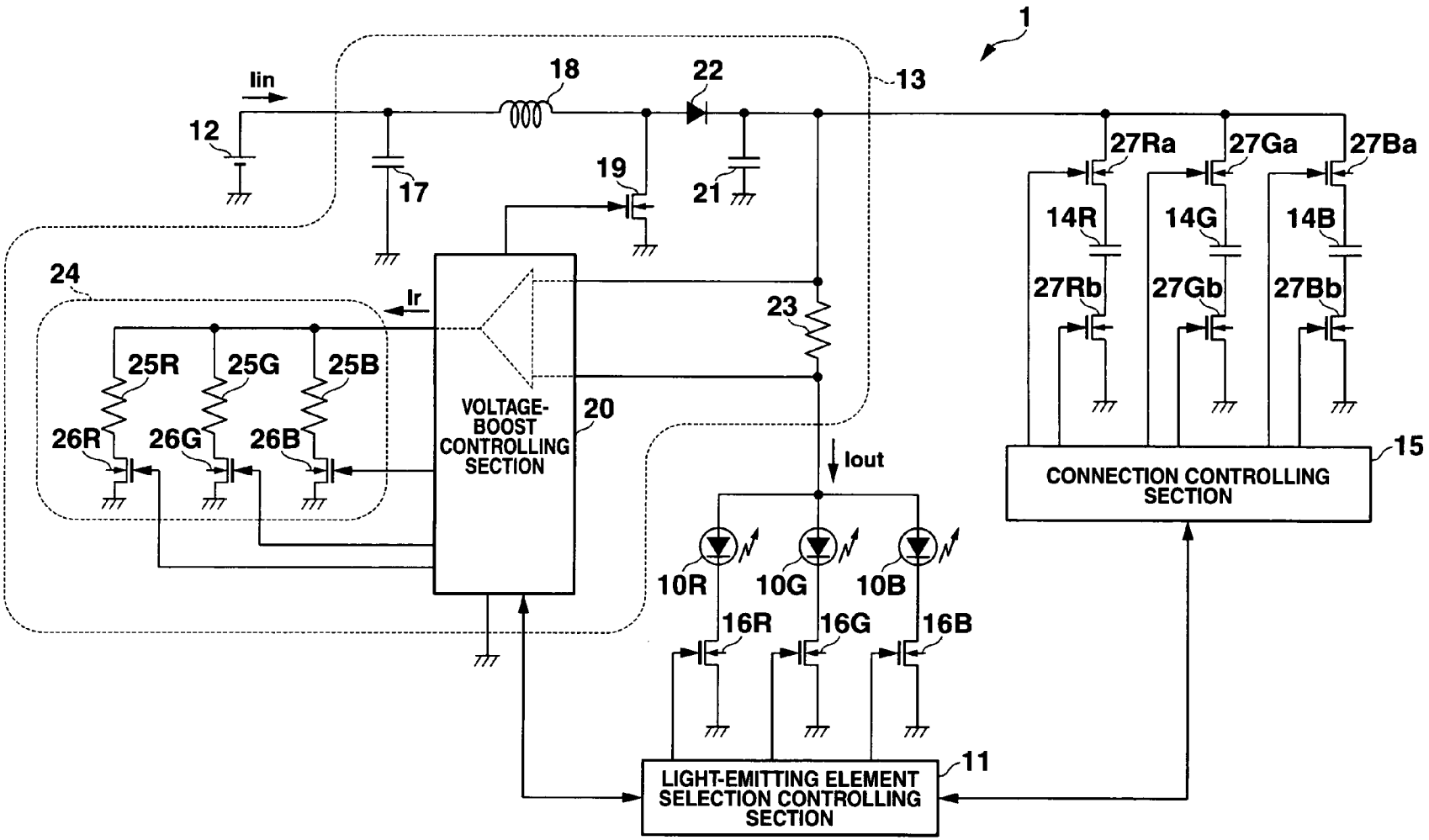
FIG. 1 is a block diagram of a light-emitting element driving apparatus for driving light emitting elements, according to the present invention.

The driving apparatus 1 of the invention is installed for example in a projector, which is used to enlarge and project onto a large screen an explanation image created with a personal computer. A functional block diagram of the driving apparatus 1 is shown in FIG. 1. As shown in FIG. 1, the driving apparatus 1 comprises a light-emitting element selection controlling section 11, direct-current power source 12, power supplying section 13, and connection controlling section 15. Further, the driving apparatus 1 is provided with subsidiary capacitors 14R, 14G and 14B, which correspond to LEDs 10R, 10G and 10B, respectively. The light-emitting element selection controlling section 11 serves to select one of LEDs 10R, 10G, 10G successively. The power supplying section 13 serves to adjust input current I-in supplied from the direct-current power source 12 to supply output current of a current value I-out to the light emitting element selected by the light-emitting element selection controlling section 11. The connection controlling section 15 serves to connect the subsidiary capacitors 14R, 14G and 14B in parallel with LEDs 10R, 10G and 10B successively at predetermined timings.

The light-emitting element selection controlling section 11 turns on or off successively switching elements 16R, 16G and 16B, which are connected in series with LEDs 10R, 10G and 10B, respectively, thereby selecting one LED out of LEDs 10R, 10G and 10B which is to be supplied with the output current I-out from the power supplying section 13.

Figure 2:
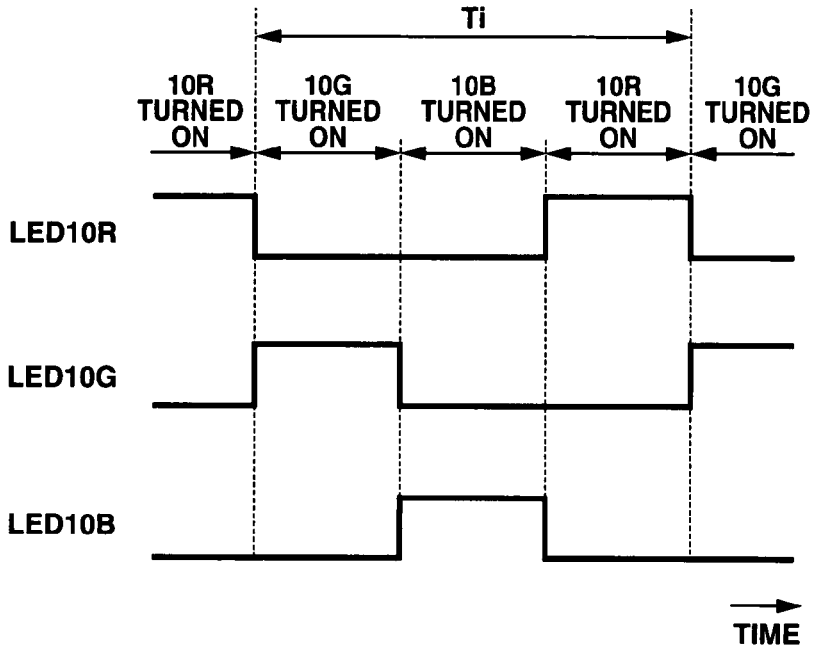
FIG. 2 is a view explaining a time sharing driving operation for driving the light emitting elements.

The light-emitting element selection controlling section 11 adjusts timing of on-off operation of the switching elements 16R, 16G and 16B to prevent plural LEDs of different colors from being turned on simultaneously, due to delay in operation of the switching elements 16R, 16G and 16B. Further, the light-emitting element controlling section 11 controls on-off operation of the switching elements 16R, 16G and 16B so as to supply current from the power supplying section 13 to LEDs 10R, 10G and 10B successively in a time sharing manner at a predetermined cycle Ti as shown in FIG. 2.

In short, the light-emitting element selection controlling section 11 controls the on-off operation of the switching elements 16R, 16G and 16B to drive LEDs 10R, 10G and 10B successively in a time sharing manner, for example, at a predetermined cycle Ti of 2.8 ms.

The power supplying section 13 comprises an input smoothing condenser 17 for smoothing a voltage of the direct current power source 12, boost coil 18 for boosting a voltage, switching element 19, voltage-boost controlling section 20 for controlling on-off operation of the switching element 19, output smoothing condenser 21 for smoothing an output voltage, rectifying diode 22 for preventing reverse current, detection register 23 for detecting a current value, and a variable setting section 24 for adjusting a current value of output current.

In the power supplying section 13, when the switching element 19 is turned on under control of the voltage-boost controlling section 20, current is supplied from the direct current power source 12 to the boost coil 18. As time lapses, energy proportional to square of current value flowing through the boost coil 18 is reserved in the boost coil 18.

When the voltage-boost controlling section 20 turns off the switching element 19 in the above state, the energy reserved in the boost coil 18 charges the output smoothing condenser 21 through the diode 22.

The rectifying diode 22 serves to prevent charge reserved in the output smoothing condenser 21 from being discharged through the switching element 19, when the switching element 19 is turned on.

The voltage-boost controlling section 20 detects a voltage drop appearing across the register 23, thereby controlling the on-off operation of the switching element 19 so as to keep a value of the output current I-out supplied to LEDs 10R, 10G and 10B at a predetermined current value.

Though depending on the energy necessary for the load, a cycle of the on-off operation of the switching element 19 is in the order of not more than several tens μS, and the switching element 19 is driven at a cycle short enough in comparison with the period Ti of the time sharing driving of LED.

Figure 3:
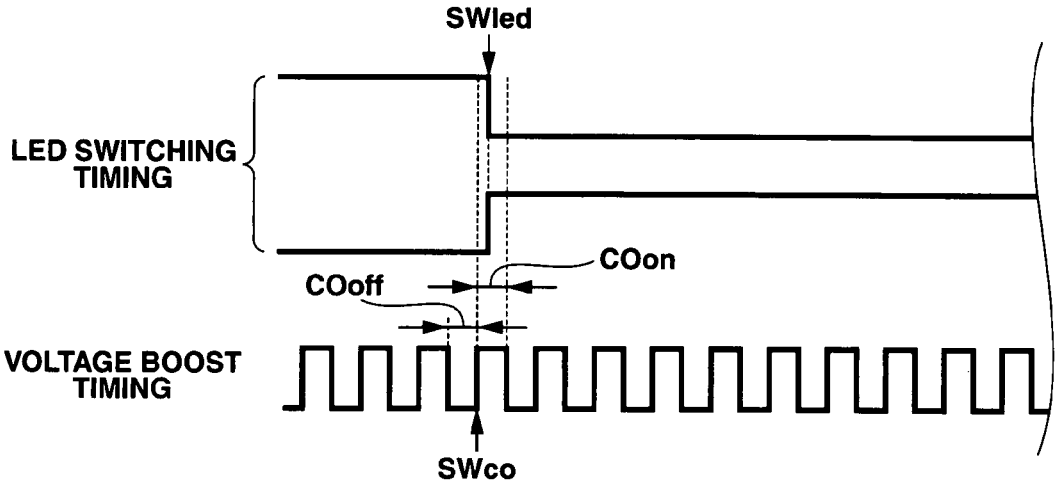
FIG. 3 is a timing chart explaining a switching operation for switching elements.

However, the voltage-boost controlling section 20 can generate a high voltage, thereby giving damage to peripheral circuit elements, when a state of light load is temporarily caused due to switching operation, since the energy reserved in the boost coil 18 is discharged to the output side while the switching element 19 is kept turned off. Therefore, it is preferable that the light-emitting element selection controlling section 11 fine adjusts a timing SW-led at which LEDs are switched to be connected to the power supplying section 13 by means of the witching elements 16R, 16G and 16B so as to fall within a period CO-on in which the switching element 19 is kept turned on, as shown in FIG. 3. Further, it is preferable that the timing SW-led is fine adjusted such that the switching operation of LEDs will be completed within the period CO-on in which the switching element 19 is kept turned on.

The voltage-boost controlling section 20 controls the variable setting section 24 so as to supply the appropriate rated currents to LEDs 10R, 10G, 10B, respectively.

More specifically, the variable setting section 24 comprises registers 25R, 25G, 25B corresponding respectively to LEDs 10R, 10G, 10B, and switching elements 26R, 26G, 26B connected respectively to the registers 25R, 25G, 25B.

One end of the appropriate register among the registers 25R, 25G, 25B is connected to a reference potential (ground) through the appropriate switching element among the switching elements 16R, 26G, 26B at the switching timing of the appropriate LED, whereby current proportional to current Ir flowing through the register (grounded register) connected to the reference potential (ground) is supplied to LED corresponding to the grounded resister. The registers 25R, 25G, 25B are set to resistance values respectively such that the currents I-out to be supplied from the power supplying section 13 to LEDs 10R, 10G, 10B are set to the rated current values for LEDs 10R, 10G, 10G, respectively.

The voltage-boost controlling section 20 controls the on-off operation of the switching elements 26R, 26G, 26B in synchronization with selection of LEDs 10R, 10G, 10B, thereby grounding the register among the registers 25R, 25G, 25B, corresponding to LED to which the power supplying section 13 supplies the current I-out.

In other words, when the power supplying section 13 supplies current to LED, the voltage-boost controlling section 20 connects to the reference potential (ground) the register corresponding to LED to which current is to be supplied, thereby setting a predetermined current value corresponding to the rated current value for the LED to adjust the output current I-out of the power supplying section 13 to the above predetermined current value.

The connection controlling section 15 controls the on-off operation of the switching elements 27Ra, 27Rb, 27Ga, 27Gb, 27Ba, and 27Bb in synchronization with selection of LEDs 10R, 10G and 10B by the light-emitting element selection controlling section 11, thereby connecting the appropriate subsidiary capacitor in parallel with LED to which the power supplying section 13 supplies current.

The subsidiary capacitors 14R, 14G and 14B corresponding respectively to LEDs 10R, 10G and 10B are connected between appropriate pairs of switching elements, respectively. More specifically, the subsidiary capacitors 14R is connected between the appropriate pair of switching elements 27Ra and 27Rb, the subsidiary capacitors 14G is connected between the appropriate pair of switching elements 27Ga and 27Gb, and the subsidiary capacitors 14B is connected between the appropriate pair of switching elements 27Ba and 27Bb.

When the power supplying section 13 supplies current to LEDs 10R, 10G and 10B, the connection controlling section 15 turns on appropriate pair of switching elements out of the switching elements 27Ra, 27Rb, 27Ga, 27Gb, 27Ba, and 27Bb to connect the appropriate subsidiary capacitor among the subsidiary capacitors 14R, 14G and 14B in parallel with LED which is to be supplied with current from the power supplying section 13, and charge corresponding to the rated voltage of such LED is reserved in the subsidiary capacitor connected in parallel with such LED.

When the power supplying section 13 ceases to supply current to the LED corresponding to the charged subsidiary capacitor, the connection controlling section 15 separates such subsidiary capacitor from the LED, thereby reserving the charge in such subsidiary capacitor.

Figure 4:
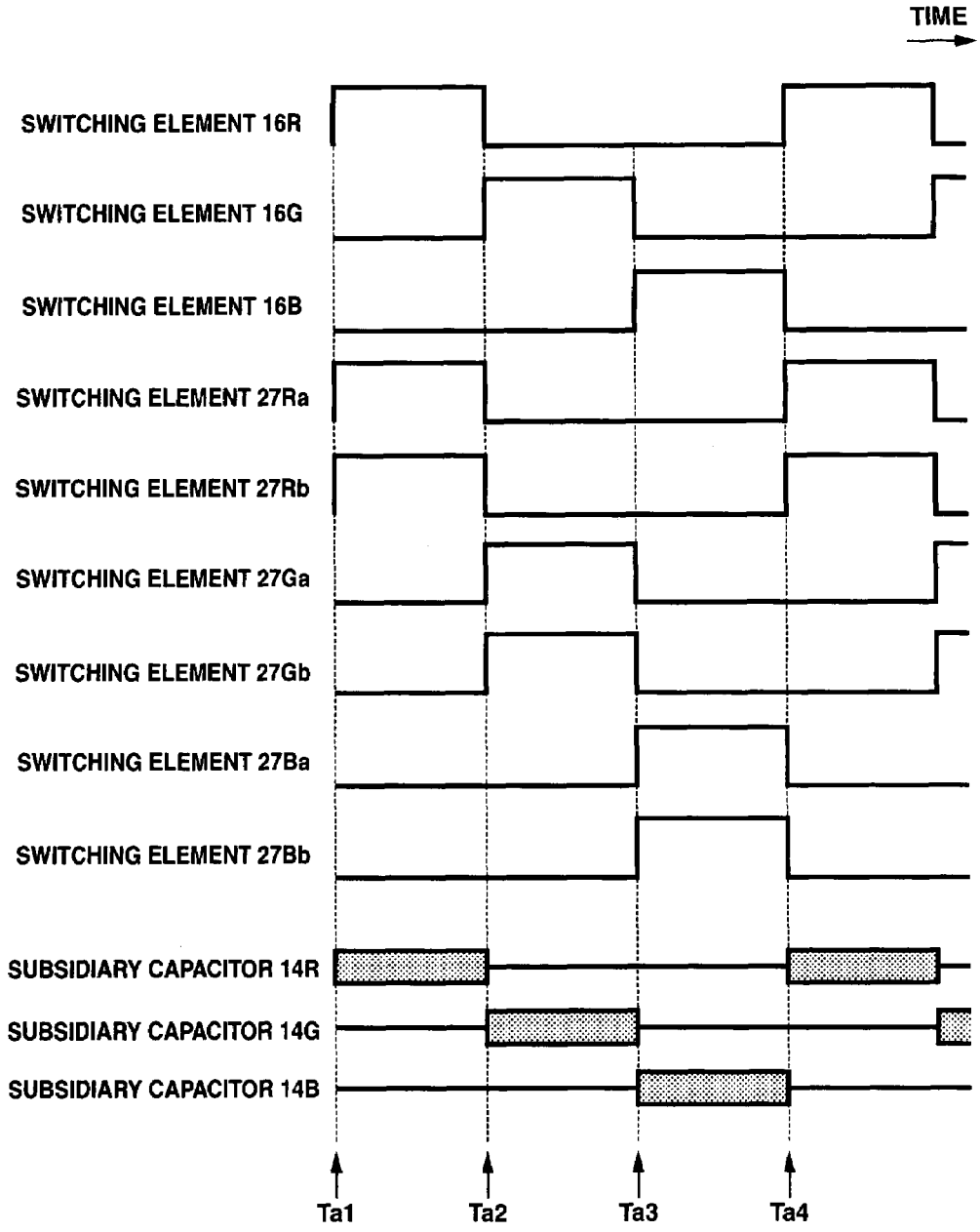
FIG. 4 is a timing chart for explaining operation of a connection controlling section.

Now, operation of the selection controlling section 15 will specifically be described with reference to a timing chart shown in FIG. 4. When the light-emitting element selection controlling section 11 switches on the switching element 16R, and simultaneously switches off the switching elements 16G and 16B so as to allow the appropriate rated current to flow through LED 10R from the power supplying section 13, the connection controlling section 15 switches on the switching elements 27Ra and 27Rb, and switches off the switching elements 27Ga, 27Gb and 27Ba, 27Bb, and connects the subsidiary capacitor 14R in parallel with LED 10R, and simultaneously separates the subsidiary capacitors 14G and 14B electrically from other elements (at a time of Ta1).

At this time, in the subsidiary capacitor 14R is reserved charge corresponding to the rated current that is supplied to LED 10R from the power supplying section 13.

Then, for the power supplying section 13 to supply the appropriate rated current to LED 10G, when the light-emitting selection controlling section 11 switches on the switching element 16G and switches off the switching elements 16R and 16B, the connection controlling section 11 switches on the switching elements 27Ba, 27Bb, and switches off the switching elements 27Ra, 27Rb, and 27Ga, 27Gb, thereby connecting the subsidiary capacitor 14G in parallel with LED 10G and electrically separating the subsidiary capacitors 14R and 14B from other elements (at a time of Ta2).

At this time, in the subsidiary capacitor 14G is reserved charge corresponding to the rated current that is supplied to LED 10G from the power supplying section 13. The subsidiary capacitor 14R keeps charge corresponding to the rated current of LED 10R.

For the power supplying section 13 to supply the appropriate rated current to LED 10B, when the light-emitting selection controlling section 11 switches on the switching element 16B and switches off the switching elements 16R and 16G, the connection controlling section 11 switches on the switching elements 27Ga, 27Gb, and switches off the switching elements 27Ra, 27Rb, and 27Ba, 27Bb, thereby connecting the subsidiary capacitor 14B in parallel with LED 10B and electrically separating the subsidiary capacitors 14R and 14B from other elements (at a time of Ta3).

At this time, in the subsidiary capacitor 14B is reserved charge corresponding to the rated current that is supplied to LED 10B from the power supplying section 13. The subsidiary capacitor 14R keeps charge corresponding to the rated current of LED 10R. The subsidiary capacitor 14G keeps charge corresponding to the rated current of LED 10G.

Furthermore, for the power supplying section 13 to supply the appropriate rated current to LED 10R, when the light-emitting selection controlling section 11 switches on the switching element 16R and switches off the switching elements 16G and 16B, the connection controlling section 11 switches on the switching elements 27Ra, 27Rb, and switches off the switching elements 27Ga, 27Gb, and 27Ba, 27Bb, thereby connecting the subsidiary capacitor 14R in parallel with LED 10R and electrically separating the subsidiary capacitors 14B and 14B from other elements (at a time of Ta4).

Figure 5:
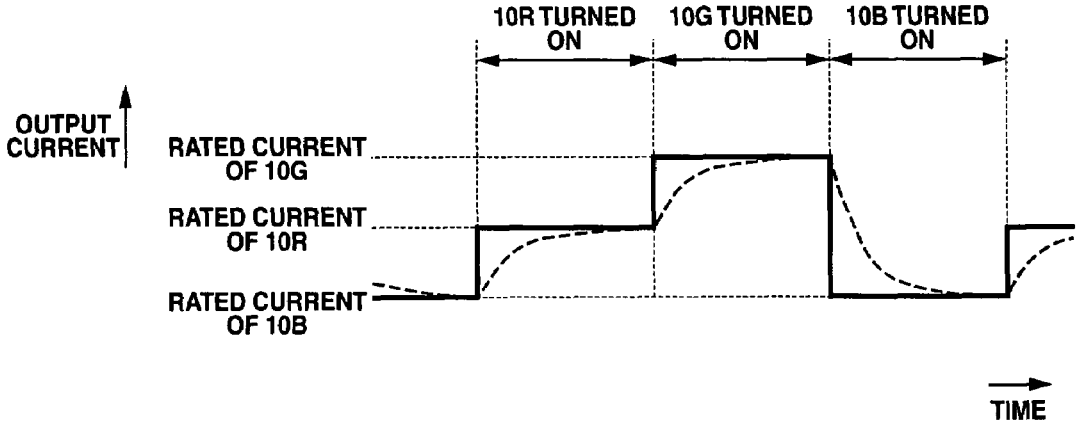
FIG. 5 is a view explaining an example of improvement in a response speed.

At this time, since in the subsidiary capacitor 14R is reserved charge corresponding to the rated current that is supplied to LED 10R from the power supplying section 13, the rated current of LED 10R flows through LED 10R from the subsidiary capacitor 14R, in addition to current flowing through LED 10R from the power supplying section 13. Therefore, even though a response is delayed, during which the power supplying section 13 changes its output current from the rated current of LED 10B to the rated current of LED 10R as shown in FIG. 5, the current flowing through LED 10R rapidly reaches the rated current, allowing the LED 10R to emit light in a stable state at the light-emitting timing.

Meanwhile, current flowing out from the subsidiary capacitor has the following feature. That is, when the rated voltage of LED switched currently is higher than the rated voltage of LED switched previously, current flows out from the subsidiary capacitor, and when the rated voltage of LED switched currently is lower than the rated voltage of LED switched previously, current flows into the subsidiary capacitor. In other words, when the power supplying section 13 supplies less power supply before LED is switched, the subsidiary capacitor compensates power shortage caused at the time when one LED has been switched to other. On the contrary, when the power supplying section 13 supplies excess power supply at the time when the LED is switched to other, the subsidiary capacitor receives such excess power supply. In this way, every time when one LED is switched to other, the voltage to be applied to the LED switched currently rapidly reaches the rated voltage for such LED, and the rated current flows through the LED. The operation described above is performed repeatedly with respect to LED 10G and 10B, and each LED is brought in a stable light-emitting state.

In the light emitting element driving apparatus 1 described above, when a common power supplying section is used to drive plural LEDs of different rated current continuously in a time sharing manner, the same number of subsidiary capacitors are provided as LEDs of different rated current or the necessary number of subsidiary capacitors are provided such that driving condition of LED is assured. A pair of subsidiary capacitors corresponding to LED to be turned on are turned on, and other pairs of subsidiary capacitors are turned off, and the subsidiary capacitor corresponding to such LED compensates power shortage or excess power to be supplied to the LED, assuring appropriate luminance of LED.

In the embodiment of the light emitting element driving apparatus described above, on-off operation of the pair of switching elements, between which the subsidiary capacitor is connected, is performed at a predetermined timing, whereby a period during which the subsidiary capacitor is connected with the appropriate LED in parallel and a period during the subsidiary capacitor is not connected to the appropriate LED are repeated. But, the invention is not limited to the above structure. Modification may be made to the light emitting element driving apparatus such that subsidiary capacitors are connected in parallel with the appropriate LED at predetermined timings.

The light emitting element driving apparatus which is used for a projector has been described in the above embodiments, but the driving apparatus may be used for another devices such as a liquid crystal display device of a direct viewing type and the like.

What is claimed is:

1. A light-emitting element driving apparatus for driving plural light emitting elements of different rated current, comprising:

capacitors provided each to be connected in parallel with an appropriate light emitting element among the plural light emitting elements;

a direct-current power source for supplying direct current;

a light-emitting element selection controlling section for selecting a light emitting element out of the plural light emitting elements successively;

a power supplying section for changing the direct current supplied from the direct-current power source to predetermined output current and supplying the output current to the light emitting element selected by the light-emitting element selection controlling section; and a connection controlling section for connecting at a predetermined timing the capacitor in parallel with the light emitting element selected by the light-emitting element selection controlling section.

2. The light-emitting element driving apparatus according to claim 1, wherein the connection controlling section connects the capacitor in parallel with the light emitting element selected by the light-emitting element selection controlling section at the timing when such light emitting element is selected by the light-emitting element selection controlling section.

3. The light-emitting element driving apparatus according to claim 2, wherein the power supplying section changes the current supplied from the direct-current power source to the rated current of the light emitting element selected by the light-emitting element selection controlling section.

4. The light-emitting element driving apparatus according to claim 3, wherein the power supplying section has a switching element for changing the current supplied from the direct-current power source to predetermined output current, and the light-emitting element selection controlling section selects a light emitting element out of the plural light emitting elements in synchronization with switching operation of the switching element in the power supplying section.

5. The light-emitting element driving apparatus according to claim 2, wherein the power supplying section has a switching element for changing the current supplied from the direct-current power source to predetermined output current, and the light-emitting element selection controlling section selects a light emitting element out of the plural light emitting elements in synchronization with switching operation of the switching element in the power supplying section.

6. The light-emitting element driving apparatus according to claim 1, wherein the power supplying section changes the current supplied from the direct-current power source to the rated current of the light emitting element selected by the light-emitting element selection controlling section.

7. The light-emitting element driving apparatus according to claim 6, wherein the power supplying section has a switching element for changing the current supplied from the direct-current power source to predetermined output current, and the light-emitting element selection controlling section selects a light emitting element out of the plural light emitting elements in synchronization with switching operation of the switching element in the power supplying section.

8. The light-emitting element driving apparatus according to claim 1, wherein the power supplying section has a switching element for changing the current supplied from the direct-current power source to predetermined output current, and the light-emitting element selection controlling section selects a light emitting element out of the plural light emitting elements in synchronization with switching operation of the switching element in the power supplying section.

9. A method of driving plural light emitting elements of different rated current in a light-emitting element driving apparatus, which has a direct-current power source for supplying direct current and capacitors provided each to be connected with an appropriate light emitting element among the plural light emitting elements, the method comprising the steps of:

(a) selecting a light emitting element out of the plural light emitting elements successively;

(b) changing the direct current supplied from the direct-current power source to predetermined output current and supplying the output current to the selected light emitting element; and (c) connecting the capacitor in parallel with the selected light emitting element at a predetermined timing.

10. A projector provided with a light-emitting element driving apparatus for plural driving light emitting elements of different rated current, comprising:

capacitors provided each to be connected in parallel with an appropriate light emitting element among the plural light emitting elements;

a direct-current power source for supplying direct current;

a light-emitting element selection controlling section for selecting a light emitting element out of the plural light emitting elements successively;

a power supplying section for changing the direct current supplied from the direct-current power source to predetermined output current and supplying the output current to the light emitting element selected by the light-emitting element selection controlling section; and a connection controlling section for connecting at a predetermined timing the capacitor in parallel with the light emitting element selected by the light-emitting element selection controlling section.

11. The projector according to claim 10, wherein the connection controlling section connects the capacitor in parallel with the light emitting element selected by the light-emitting element selection controlling section at the timing when such light emitting element is selected by the light-emitting element selection controlling section.

12. The projector according to claim 11, wherein the power supplying section changes the current supplied from the direct-current power source to the rated current of the light emitting element selected by the light-emitting element selection controlling section.

13. The projector according to claim 12, wherein the power supplying section has a switching element for changing the current supplied from the direct-current power source to predetermined output current, and the light-emitting element selection controlling section selects a light emitting element out of the plural light emitting elements in synchronization with switching operation of the switching element in the power supplying section.

14. The projector according to claim 11, wherein the power supplying section has a switching element for changing the current supplied from the direct-current power source to predetermined output current, and the light-emitting element selection controlling section selects a light emitting element out of the plural light emitting elements in synchronization with switching operation of the switching element in the power supplying section.

15. The projector according to claim 10, wherein the power supplying section changes the current supplied from the direct-current power source to the rated current of the light emitting element selected by the light-emitting element selection controlling section.

16. The projector according to claim 15, wherein the power supplying section has a switching element for changing the current supplied from the direct-current power source to predetermined output current, and the light-emitting element selection controlling section selects a light emitting element out of the plural light emitting elements in synchronization with switching operation of the switching element in the power supplying section.

17. The projector according to claim 10, wherein the power supplying section has a switching element for changing the current supplied from the direct-current power source to predetermined output current, and the light-emitting element selection controlling section selects a light emitting element out of the plural light emitting elements in synchronization with switching operation of the switching element in the power supplying section.

* * * * *